United States Patent [19]

Wakabayashi

[11] Patent Number: 4,771,700

[45] Date of Patent: Sep. 20, 1988

[54] POWER-AND-FREE CONVEYOR

[75] Inventor: Takao Wakabayashi, Toyonaka, Japan

[73] Assignee: Nakanishi Metal Works Co., Ltd., Osaka, Japan

[21] Appl. No.: 876,582

[22] Filed: Jun. 20, 1986

[30] Foreign Application Priority Data

Jul. 23, 1985 [JP] Japan ..... 60-163402
Nov. 25, 1985 [JP] Japan ..... 60-265481

[51] Int. Cl.[4] ..... B65G 17/00; B61B 10/00
[52] U.S. Cl. ..... 104/172.3; 104/172.4
[58] Field of Search ..... 104/172.1, 172.3, 172.4

[56] References Cited

U.S. PATENT DOCUMENTS

| | | | |
|---|---|---|---|
| 3,353,500 | 11/1967 | Orwin | 104/172.4 |
| 3,424,112 | 1/1969 | Orwin | 104/172.4 |
| 3,726,234 | 4/1973 | Dema et al. | 104/172.4 |
| 4,424,749 | 1/1984 | Wakabayashi | 104/96 X |
| 4,483,252 | 11/1984 | Pierson | 104/172.3 |
| 4,542,698 | 9/1985 | Wakabayashi | 104/172.4 |
| 4,616,570 | 10/1986 | Dehne | 104/172.3 |

*Primary Examiner*—Joseph Falk
*Assistant Examiner*—Peter R. Brown
*Attorney, Agent, or Firm*—Armstrong, Nikaido, Marmelstein & Kubovcik

[57] ABSTRACT

A power-and-free conveyor comprising a power line, a free line coextensive with the power line thereabove, a multiplicity of pivotally movable pushers adapted to travel with a drive chain for the power line, and free trolleys attached to carriers on the free line, each of the pushers being generally T-shaped when seen from front and including an attaching member and a horizontal engaging member provided at the forward end of the attaching member, each of the free trolleys having an engaging dog comprising a pair of opposed vertical engaging portions which are spaced apart from each other transversely of the free line at a distance, the engaging pusher member being engageable with at least one of the engaging portions of the engaging dog. The free trolley comprises a main body and a slider mounted thereon and slidable longitudinally of the trolley, the slider being provided with an engaging dog and an anticoasting dog, the slider being connected to the main body by a shock absorber.

2 Claims, 8 Drawing Sheets

POWER-AND-FREE CONVEYOR

BACKGROUND OF THE INVENTION

The present invention relates to a power-and-free conveyor.

Power-and-free conveyors are already well known which comprise a power line, a free line coextensive with the power line thereabove, a multiplicity of pivotally movable pushers adapted to travel with a drive chain for the power line, engaging dogs mounted on carrier free trolleys on the free line, and anticoasting dogs mounted on the free trolleys and each opposed to the engaging dog. These conveyors are used for automating flow production. With the conveyor line system, carriers are switched for joining or diversion from one line to another article processing line, or the pushers propelling carriers are changed over to other pushers. A carrier stopping device or the like which is separate from the power-and-free conveyor is conventionally used in such a case for joining or diverting carriers or for changing pushers. The system therefore has the problem of requiring a very high equipment cost and a wide space.

Accordingly, it has recently been desired to provide a power-and-free conveyor in which pushers can be changed over or carriers can be joined together or diverted without necessitating any special device other than the conveyor.

The conventional conveyor has another problem. Since the engaging dog and the anticoasting dog are fixed to the free trolley, the engagement of the pusher with the engaging dog exerts great impact on the free trolley and consequently to the carrier, causing trouble to the work on the article in transit, such as a motor vehicle assembly, and further producing noises.

SUMMARY OF THE INVENTION

The main object of the present invention is to provide a power-and-free conveyor free of the foregoing problems.

The present invention provides a power-and-free conveyor of the type described characterized in that the pusher is generally T-shaped when seen from front and includes an attaching member and a horizontal engaging member provided at the forward end of the attaching member, the free trolley having an engaging dog comprising a pair of opposed vertical engaging portions which are spaced apart from each other transversely of the free line at a specified distance, the horizontal engaging member of the pusher being engageable with at least one of the vertical engaging portions of the engaging dog. The conveyor is further characterized in that the free trolley comprises a main body and a slider mounted thereon and slidable longitudinally of the trolley, the slider being provided with the engaging dog and the anticoasting dog, the slider being connected to the main body by a shock absorber.

With the power-and-free conveyor of the present invention, one pusher can be changed over to another, or carriers can be switched from one line to another for joining or diversion properly without necessitating any special device, while the conveyor is very simple in construction and is very low in equipment cost. Furthermore, the pusher is engageable with the free trolley engaging dog or the carrier can be stopped without subjecting the carrier to any impact and without producing noises. The conveyor therefore assures very quiet efficient flow production, for example, of motor vehicles.

DESCRIPTION OF THE PREFERRED EMBODIMENT

Figure 1:
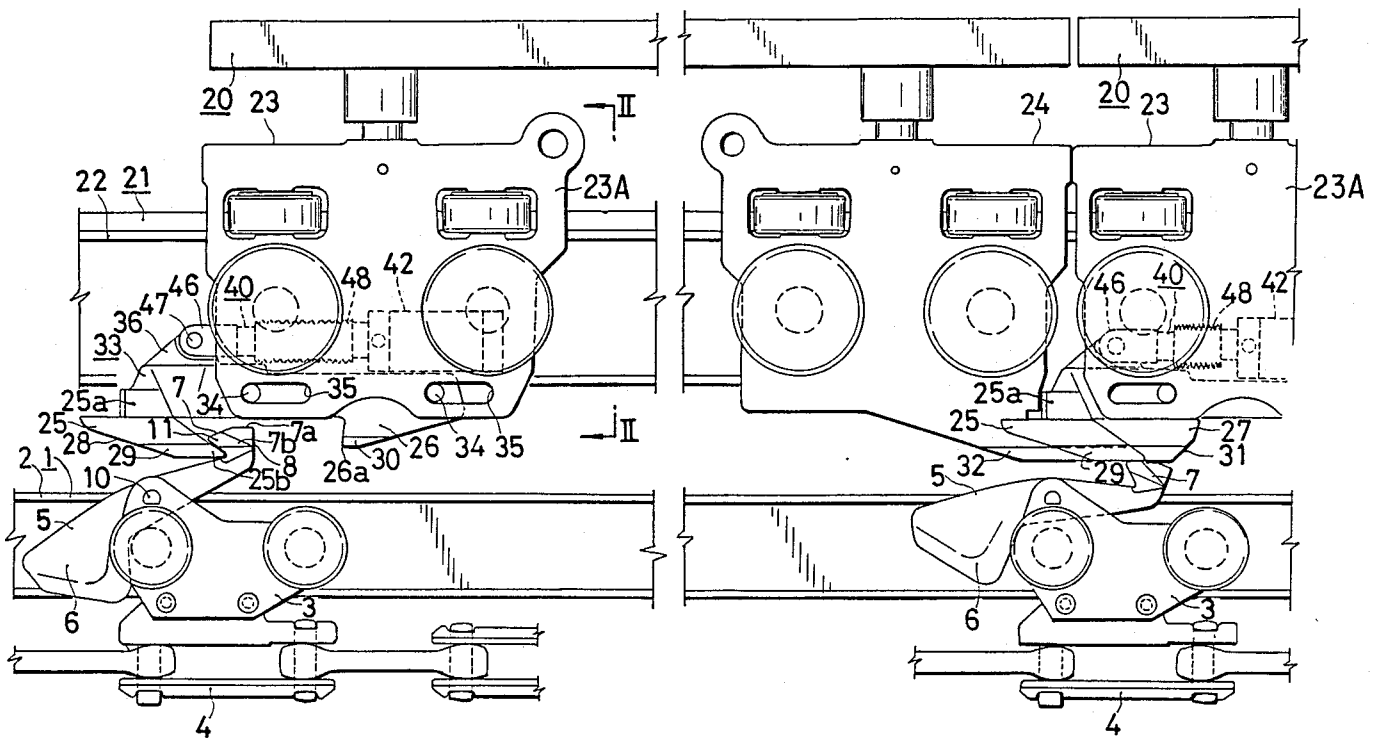
FIG. 1 is a fragmentary left side elevation on an enlarged scale showing a power-and-free conveyor.

The terms "front," "rear," "right" and "left" as herein used are based on FIG. 1. "Front" refers to the left side of FIG. 1, "rear" to the right side thereof, "right" to the back side of the plane of FIG. 1, and "left" to the front side of the same.

Figure 2:
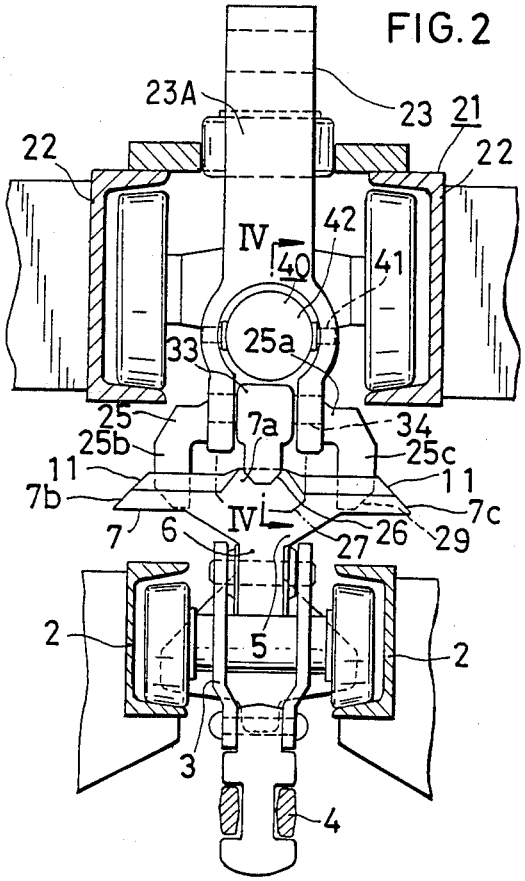
FIG. 2 is a view in section taken along the line II—II in FIG. 1.
Figure 3:
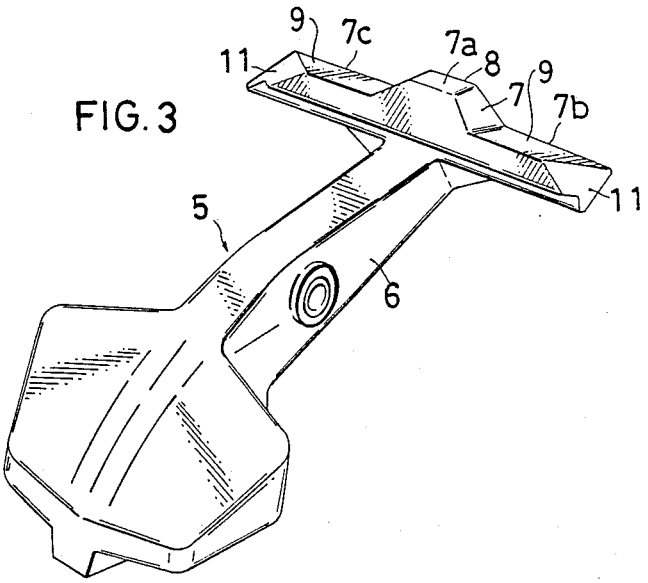
FIG. 3 is an enlarged perspective view showing a pusher.

With reference to FIGS. 1 to 3, a power-and-free conveyor, which is of the type to be installed under the floor, comprises a power line 1 composed of a pair of opposed power rails 2, a free line 21 composed of a pair of opposed free rails 22 and coextensive with the power line 1 thereabove, a multiplicity of pivotally movable pushers 5 adapted to travel with a drive chain 4 for the power line 1, and a pair of front and rear free trolleys 23, 24 attached to each carrier 20 on the free line 21. The front free trolley 23 comprises a main body 23A and a slider 33 provided inside the main body 23A and slidable forward or rearward. The slider 33 is provided on each of its right and left sides with a pair of outwardly projecting slide pins 34, 34 inserted in slots 35, 35 extending longitudinally of the trolley and formed in the opposed side walls of the main body 23A. Accordingly, the slider 33 is slidable forward or rearward over a distance corresponding to the amount of movement of the pins 34, 34 in the slots 35, 35. The slider 33 has at its front end a downwardly projecting engaging dog 25 and at its rear end an anticoasting dog 26 opposed to the engaging dog 25.

The slider 33 is connected to the main body 23A by a shock absorber 40.

Each pusher 5 comprises an attaching member 6 pivoted by a pin 10 to a power trolley 3 and an engaging member 7 provided horizontally at the rearward end of the attaching member 6, the pusher 5 being generally T-shaped when seen from front. The engaging member 7 includes a center portion *7a* having an increased thickness and a dog engaging face 8 at its rear end, and opposite side portions *7b*, *7c* having a reduced thickness and an overrunning dog passing inclined face 9 which extends forwardly upward from the rear edge of each side portion.

Each engaging dog 25 comprises a horizontal connecting portion 25*a* integral with the front end of the slider 33 and vertical engaging portions 25*b*, 25*c* extending from the opposite ends of the portion 25*a*, the engaging dog 25 resembling a gate when seen from front. Each of the vertical engaging portions 25*b*, 25*c* has at its front end a pusher depressing inclined face 28 extending obliquely forwardly upward.

The vertical engaging portions 25*b*, 25*c* of the engaging dog 25 are formed each at its outer end with an inclined face 29 for depressing the pusher 5 from one side. Each of the side portions 7*b*, 7*c* of the horizontal engaging member 7 of the pusher 5 has at its outer end a side collision preventing inclined face 11 which is adapted to come into contact with the inclined face 29. These faces 29 and 11 are inclined at an angle of about 30 to about 45 degrees.

The anticoasting dog 26 opposed to and spaced at a distance from the engaging dog 25 on the slider 33 has its outer end 26*a* held at a level for this end 26*a* to come into contact with the overrunning dog passing inclined faces 9, 9 of the side portions 7*b*, 7*c* of the engaging pusher member 7. The dog 26 has on each side of its outer end an inclined face 30 for depressing the pusher 5 sideways.

Figure 4:
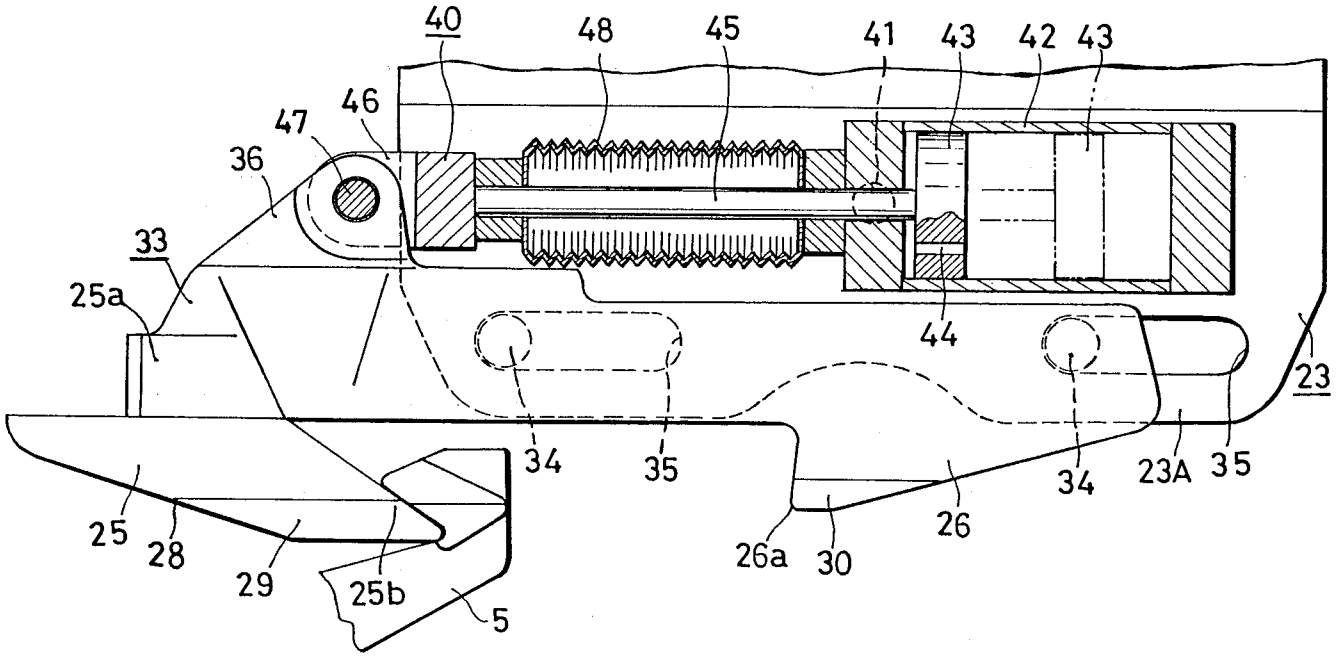
FIG. 4 is an enlarged view in section taken along the line IV—IV in FIG. 2.

As seen in FIG. 4, the shock absorber 40 comprises a cylinder 42 pivoted to the free trolley main body 23A by a pair of opposite pins 41, 41, a piston 43 slidably housed in the cylinder 42 and having an orifice 44 extending through the piston longitudinally of the cylinder for passing air or like fluid, and a piston rod 45. The piston rod 45 has one end fixed to the piston 43 within the cylinder 42 and the other end attached to a connector 46. Outside the cylinder 42, the connector 46 is attached by a pin 47 to an upward projection 36 at the front end of the slider 33. A bellows-shaped tubular protective cover 48 is provided between and interconnects the connector 46 and the front wall of the cylinder 42. The portion of the piston rod 45 projecting forward from the cylinder 42 is covered with the protective cover 48.

An accumulating cam 27 is attached to the rear free trolley 24 of the carrier 20. The accumulating cam 27 is in the form of a bar, has at its rear end an inclined face 31 for depressing the pusher 5 when the pusher approaches from behind and is formed on each side of its lower end with an inclined face 32 for depressing the pusher 5 sideways.

When the pusher 5, travelling with the drive chain 4, comes into engagement with the engaging dog 25 on the front trolley 23 of the carrier 20, the piston rod 45 of the shock absorber 40 is advanced forward to move the piston 43 forward within the cylinder 42 at the same time, causing air or like fluid in the space on the front side of the piston 43 within the cylinder 42 to flow through the orifice 44 into the space on the rear side of the piston, whereby the impact due to the engagement of the pusher 5 with the engaging dog 25 is mitigated.

While the carrier 20 is in travel in usual state, the horizontal engaging member 7 of the pusher 5 is in engagement with the opposed vertical engaging portions 25*b*, 25*c* of the engaging dog 25 as shown in FIG. 2.

Figure 5:
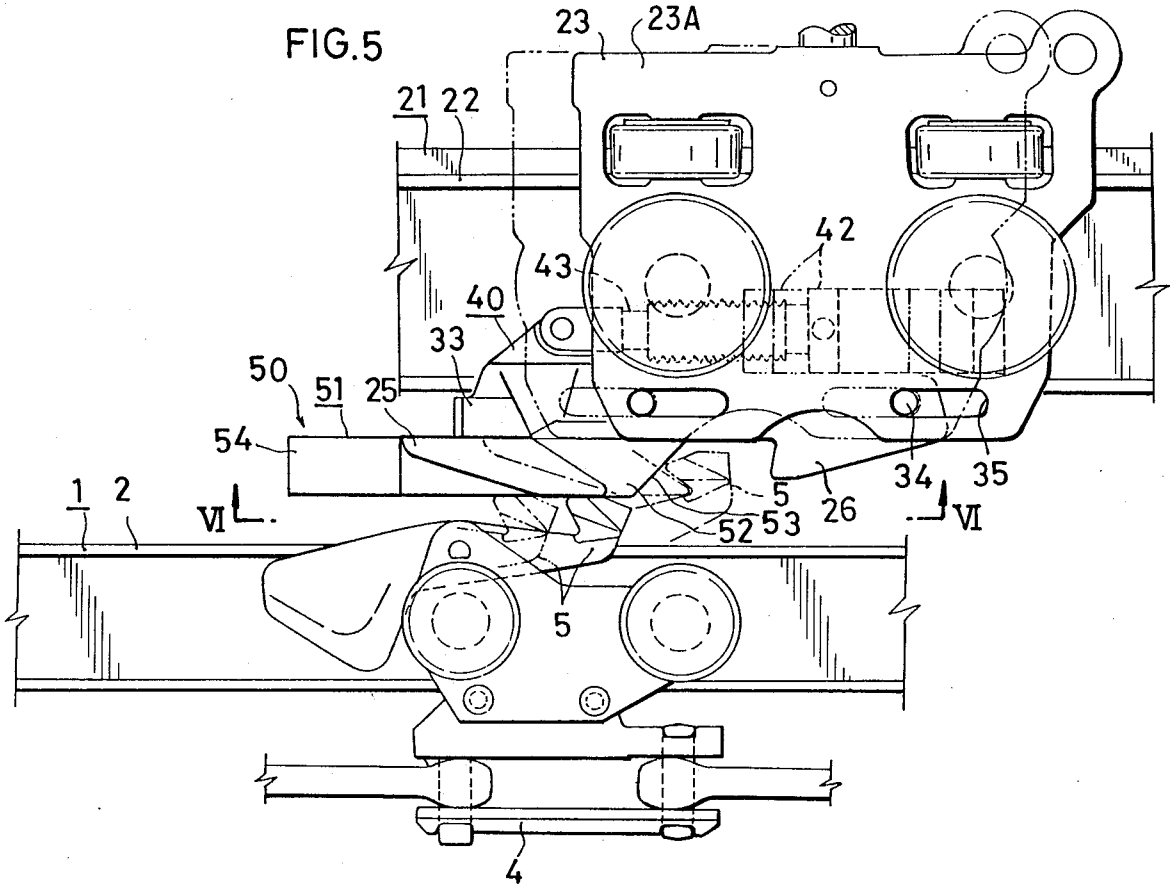
FIG. 5 is a fragmentary left side elevation on an enlarged scale showing the conveyor with a carrier at rest.
Figure 6:
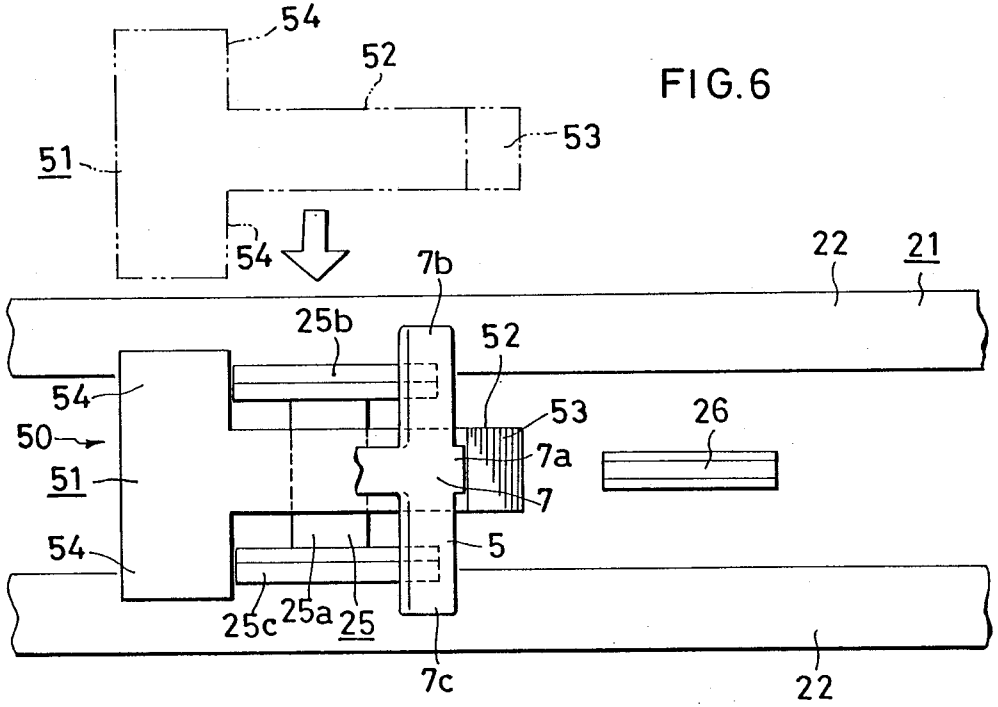
FIG. 6 is an enlarged fragmentary bottom view in section taken along the line VI—VI in FIG. 5.

When the carrier 20 is to be stopped at a desired location on the conveyor line, a carrier stopping device 50 is used as shown in FIGS. 5 and 6. The device 50 comprises a disengaging member 51 generally T-shaped when seen from below and disposed at one side of the conveyor line horizontally movably. The member 51 includes a central disengaging portion 52 and stoppers 54, 54 at opposite sides of its front end. The disengaging portion 52 has at its rear end an inclined face 53 for depressing the horizontal engaging member 7 of the pusher 5 to release the pusher 5 from the engaging dog 25 on the front trolley 23. The stoppers 54, 54 are adapted to come into contact with the front ends of the engaging portions 25*b*, 25*c* of the engaging dog 25.

The stopper-equipped disengaging member 51 of the carrier stopping device 50 is usually disposed at one side of the conveyor line in a standby position at a distance therefrom.

When a desired carrier 20 is to be stopped, the disengaging member 51 is horizontally shifted from the standby position to above the conveyor line. When the front free trolley 23 of the carrier 20 approaches as propelled by a pusher 5, the inclined face 53 of the central disengaging portion 52 depresses the pusher 5 out of engagement with the engaging dog 25. While the pusher continues to advance as held depressed by the lower surface of the disengaging portion 52, the front ends of the opposed vertical engaging portions 25*b*, 25*c* of the engaging dog 25 come into contact with and are stopped by the stoppers 54, 54, whereby the slider 33 integral with the engaging dog 25 is retracted. The slider 33 retracts the piston rod 45 of the shock absorber 40 and also the piston 43 within the cylinder 42 thereof, causing air or like fluid in the space behind the piston 43 to flow through the orifice 44 into the space on the front side of the piston. This mitigates the impact due to the contact of the engaging portions 25*b*, 25*c* with the stoppers 54, 54, permitting the front free trolley 23 and the carrier 20 to stop slowly. With the carrier 20 thus brought to a halt, the piston 43 of the shock absorber 40 within the cylinder 42 is positioned at the rear end thereof, ready for the subsequent travel of the carrier 20.

When a carrier 20 is to join the preceding carrier 20 at rest, the inclined face 31 at the rear end of barlike accumulating cam 27 on the rear free trolley 24 of the preceding carrier 20 at rest depresses the center portion of the pusher 5 propelling the front free trolley 23 of the following carrier 20, bringing the pusher 5 out of engagement with the engaging dog 25 of the front free trolley 23. Subsequently, the front end of the dog 25 comes into contact with the rear end of the rear free trolley 24 of the preceding carrier 20 at rest, whereby the engaging dog 25 and the slider 33 integral therewith are slowly retracted to permit the following carrier 20 to stop slowly under the action of its shock absorber 40. After the following carrier 20 has been thus stopped, the piston 43 within the cylinder 42 of the shock absorber 40 is positioned at the rear end thereof and is ready for the subsequent travel of the carrier 20.

FIGS. 7 to 10 show a specific arrangement wherein a carrier 20 on one free line 21 is forwarded by pushers 5A, 5B on two different power lines 1A, 1B is a transfer zone.

Figure 7:
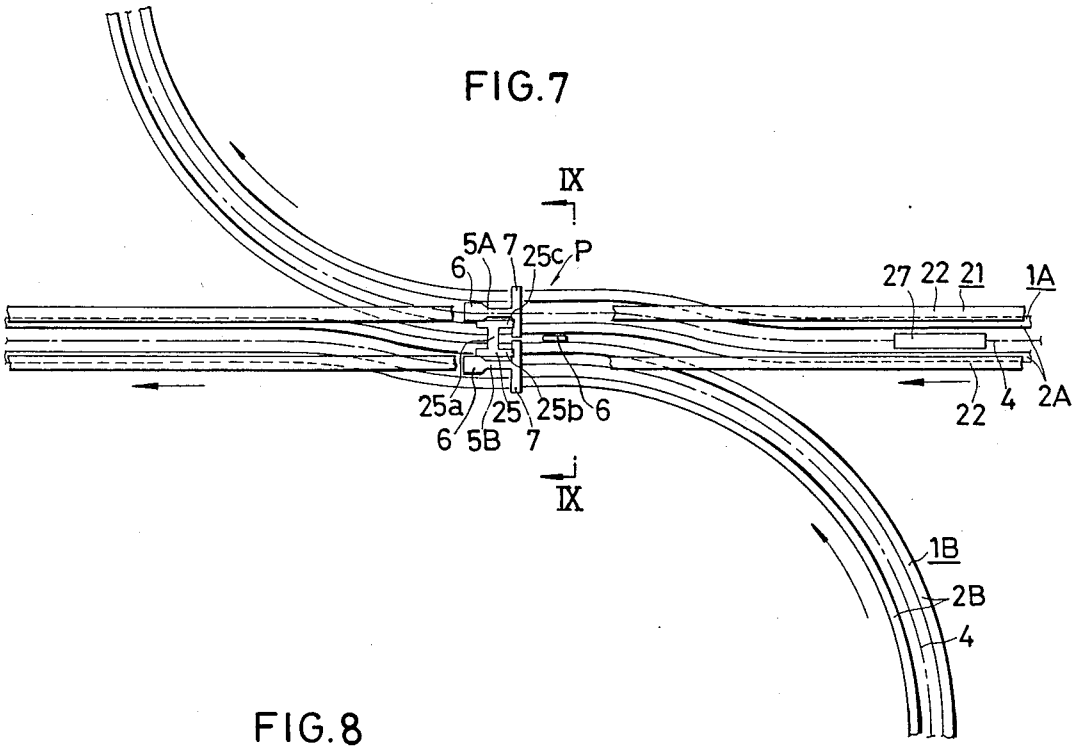
FIG. 7 is a fragmentary plan view schematically showing a power line switch portion of the conveyor.
Figure 8:
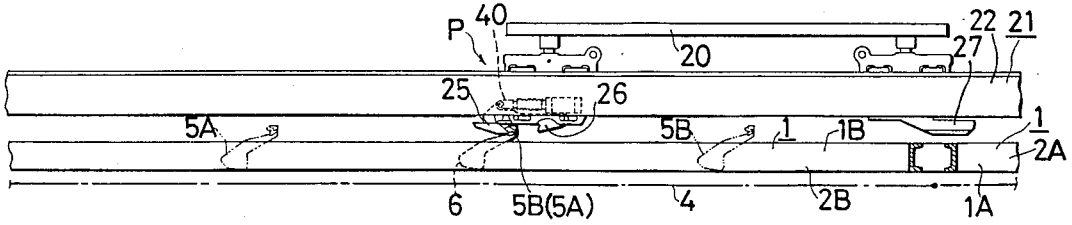
FIG. 8 is a left side elevation of FIG. 7.
Figure 9:
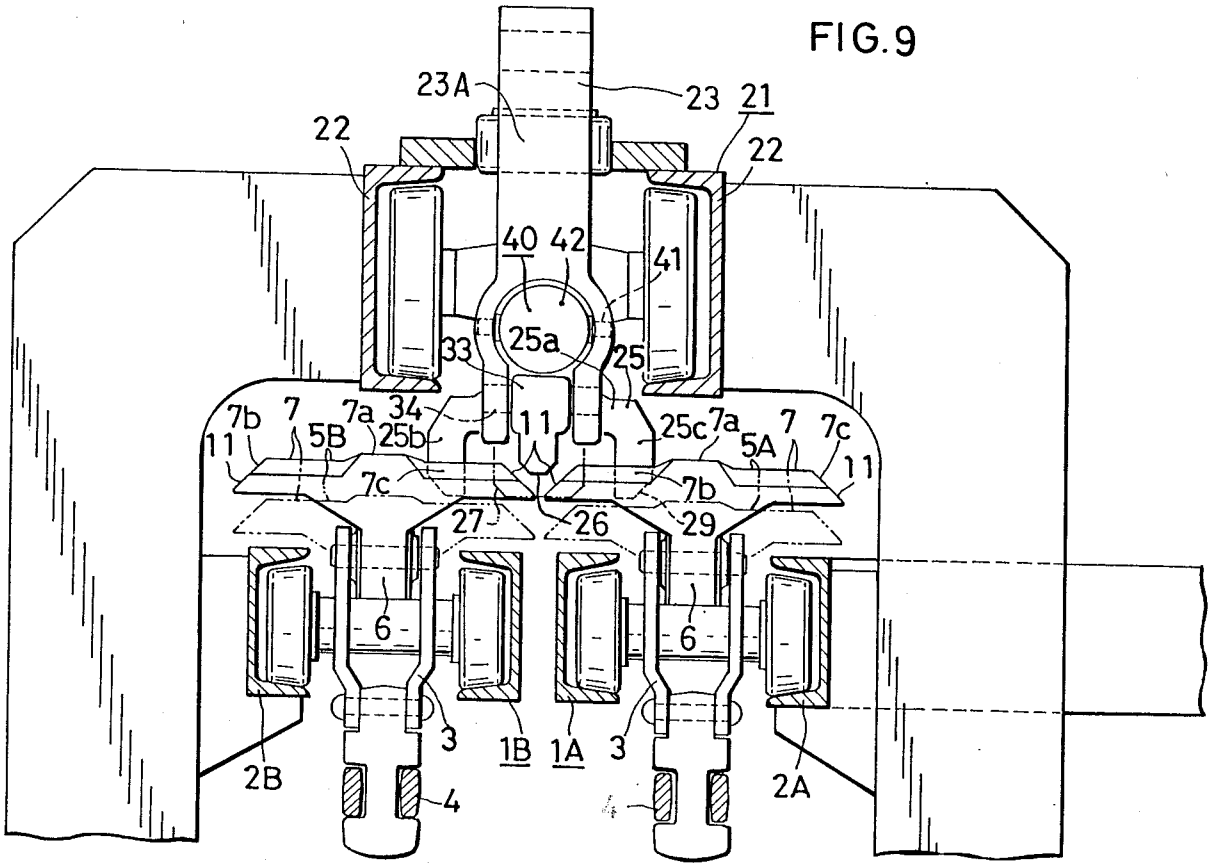
FIG. 9 is an enlarged view in section taken along the line IX—IX in FIG. 7.

The power-and-free conveyor of the type installed under the floor and shown in FIGS. 7 to 9 comprises first and second power lines 1A, 1B arranged partly in parallel, a free line 21 partly coextensive with the two power lines 1A, 1B thereabove, many pivotally movable pushers 5A, 5B and adapted to travel with drive chains 4 of the power lines 1A, 1B, respectively, and an engaging dog 25 mounted on the free front trolley 23 of each carrier 20 on the free line 21 and engageable with the pushers 5A, 5B.

Each of the first and second power lines 1A, 1B is composed of a pair of opposed steel channel members serving as power rails 2A or 2B. The free line 21 comprises a pair of opposed free rails 22 each in the form of a steel channel member. At a section P where the first and second power lines 1A, 1B extend in parallel, the power lines 1A, 1B are arranged at opposite sides of the free line 21.

The operation of the conveyor will be described next.

Before the carrier 20 on the free line 21 reaches the power line parallel section P, the opposite side portions *7b, 7c* of the horizontal engaging member 7 of a pusher 5A on the first power line 1A are in engagement with both of the opposed vertical engaging portions *25b, 25c* of the engaging dog 25 on the carrier 20 as seen in FIG. 2 to propell the carrier 20. When the carrier 20 approaches the parallel section P, the left side portion *7b* of the engaging member 7 of the pusher 5A comes into engagement with the right vertical engaging portion *25c* of the engaging dog 25 as shown in FIG. 9 since the first power line 1A is shifted with respect to the free line 21. Pushers 5B on the second power line 1B are free to travel until they reach the section P.

Beyond the section P, the first power line 1A extends away from the free line 21, so that the pusher 5A is disengaged from the right engaging portion *25c* of the engaging dog 25 to leave the carrier 20. In the parallel section P, an advancing pusher 5B on the second power line 1B comes into engagement with the left engaging portion *25b* of the engaging dog 25 on the carrier 20, which is thereafter propelled by the pusher 5B on the second power line 1B. Beyond the section P, the second power line 1B extends immediately below the free line 21, so that the opposite side portions *7b, 7c* of the engaging member 7 of the pusher 5B are brought into engagement with both of the opposed vertical engaging portions *25b, 25c* of the dog 25 as shown in FIG. 2.

The first power line 1A and the second power line 1B may be the same or different in the speed of travel of the pushers 5A and 5B. The carrier 20 can be forwarded irrespective of the speed difference between the pushers 5A and 5B.

More specifically stated, no problem of course arises when the pushers 5A, 5B on the first and second power lines 1A, 1B are driven at equal speeds.

When the pusher 5A on the first power line 1A is slower than the pusher 5B on the second power line 1B, the carrier 20 as brought to the parallel section P by the slower pusher 5A can be subsequently forwarded by the faster pusher 5B without any problem.

Figure 10:
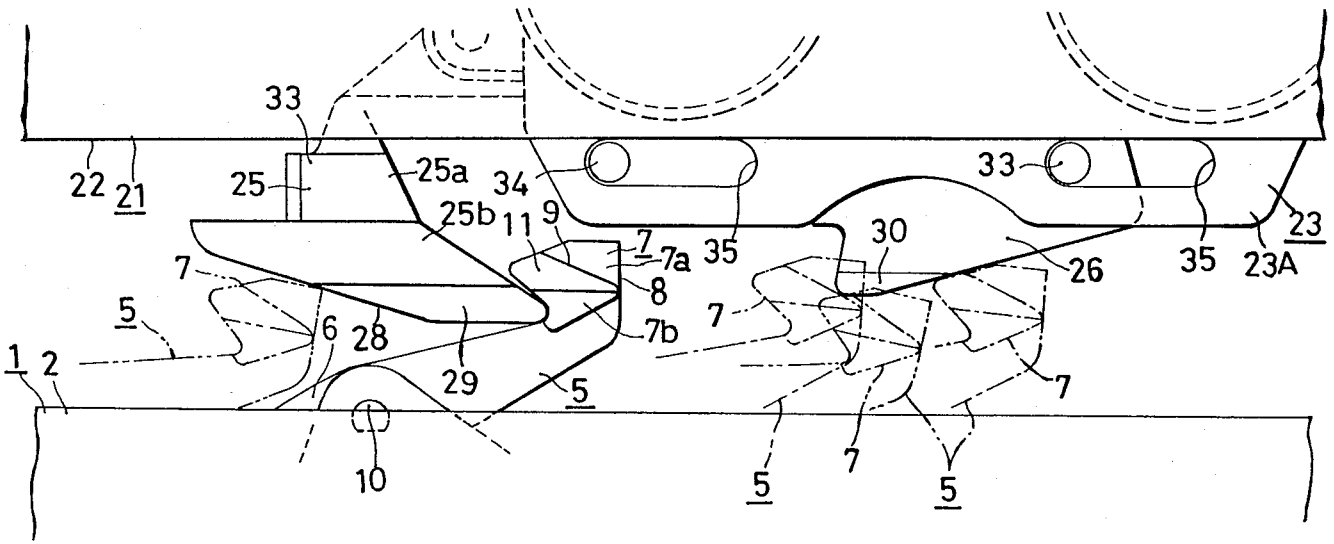
FIG. 10 is an enlarged fragmentary side elevation of the conveyor showing a pusher as it is being overrun by a carrier.

Finally, suppose the pusher 5A on the first power line 1A is faster than the pusher 5B on the second power line 1B. When the carrier 20 is brought into the section P as propelled by the faster pusher 5A, with the slow pusher 5B already positioned in the section P, the upper end of the slow pusher 5B is depressed by the inclined face 28 at the front end of the engaging dog 25 on the carrier 20, and the lower end *26a* of the anticoasting dog 26 further comes into contact with the overrunning dog passing inclined surface 9 of the horizontal engaging member 7 of the pusher 5B to depress the pusher 5B as seen in FIG. 10. No contact occurs between the center portion *7a* and the anti-coasting dog 26. Consequently, the carrier 20 overruns the pusher 5B. At a location beyond the section P, the faster pusher 5A on the first power line 1A leaves the carrier 20, so that the slow pusher 5B on the second power line 1B thereafter overtakes the carrier 20 to further propel the carrier 20. Thus, no problem arises.

Since the slider 33 having the engaging dog 25 and the anticoasting dog 26 is connected by the shock absorber 40 to the main body 23A of the front free trolley 23 of each carrier 20, the pusher 5 is engageable with the engaging dog 25 with diminished impact without producing noises by the action of the shock absorber 40.

It is noted that the engaging dog 25, the anti-coasting dog 26 and the accumulating cam 27 on the carrier 20 have on their opposite sides pusher depressing inclined faces 29, 30 and 32, respectively, and that each end of the horizontal engaging member 7 of the pusher 5B has the side collision preventing inclined face 11. Accordingly, when the carrier 20 propelled by a pusher 5A on the first power line 1A and a pusher 5B on the second power line 1B enter the parallel section P at the same time, the pusher depressing inclined face comes into contact with the collision preventing inclined face 11 of the pusher 5B to depress the pusher 5B. Consequently, no side collision occurs.

With the power-and-free conveyor of the present invention, carriers 20 can be switched from one line to another for joining or diversion in the same manner as in the above embodiment although not shown.

The shock absorber 40 is not limited to the illustrated structure but may comprise a coiled spring or the like.

Although the present invention has been described above as embodied as a power-and-free conveyor of the type to be installed under the floor, the invention is similarly applicable to overhead power-and-free conveyors by modifying the arrangement of components and inverting the relation of the pusher 5 to the opposed members involving gravity.

Although the illustrated carrier 20 has a pair of front and rear free trolleys 23, 24, two intermediate free trolleys may be connected between these trolleys, with an article support member supported by the intermediate trolleys, when elongated articles are to be transported.

What is claimed is:

1. A power-and-free conveyor comprising a power line, a free line coextensive with the power line, a multiplicity of pivotally movable pushers adapted to travel with a drive chain provided for the power line, and free trolleys attached to carriers on the free line, each of the pushers being generally T-shaped when seen from the direction of travel of the conveyor and including an attaching member and a horizontal engaging member provided rearwardly in the direction of travel of the attaching member, the horizontal engaging member comprising a center portion having a dog engaging face and opposite side portions each having an overrunning dog passing inclined face, said center portion extending toward said free line further than said side portions, each of the free trolleys having an engaging dog comprising a pair of opposed vertical engaging portions, the vertical engaging portions being spaced apart from each other transversely of the free line at a specified distance and each having at an end in the direction of travel of the conveyor a pusher depressing inclined face, each free trolley having an anti-coasting dog opposed to the engaging dog, the anti-coasting dog having an outer end extending toward said power line to a level sufficient for the outer end to come into contact with said center portion of said horizontal engaging member outside of a transfer zone and with the overrunning dog passing inclined face of either side portion of the horizontal engaging pusher member in a transfer zone, the horizontal engaging pusher member being engageable with at least one of the opposed vertical engaging portions of the engaging dog, whereby interfering engagement between the pusher and the anti-coasting dog in the transfer zone is avoided.

2. A power-and-free conveyor as defined in claim 1 wherein each of the vertical engaging portions of the engaging dog is formed on a laterally outer surface thereof with an inclined surface for depressing the pusher during lateral contact, and the anti-coasting dog has on each side of the outer end an inclined surface for depressing the pusher during lateral contact, the horizontal engaging member of each pusher being formed at the laterally outer end of each side portion thereof with a side collision preventing inclined face adapted to come into contact with the inclined surfaces in a transfer zone.

* * * * *